US011493879B2

(12) United States Patent
Sakai et al.

(10) Patent No.: US 11,493,879 B2
(45) Date of Patent: Nov. 8, 2022

(54) CARTRIDGE, IMAGE FORMING APPARATUS, AND METHOD FOR MANUFACTURING CARTRIDGE

(71) Applicant: CANON KABUSHIKI KAISHA, Tokyo (JP)

(72) Inventors: Kengo Sakai, Kanagawa (JP); Yukio Kubo, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/363,482

(22) Filed: Jun. 30, 2021

(65) Prior Publication Data

US 2022/0004144 A1 Jan. 6, 2022

(30) Foreign Application Priority Data

Jul. 3, 2020 (JP) ..... JP2020-115896

(51) Int. Cl.
*G03G 21/16* (2006.01)
*G03G 21/18* (2006.01)

(52) U.S. Cl.
CPC ..... *G03G 21/1878* (2013.01); *G03G 21/1652* (2013.01)

(58) Field of Classification Search
CPC ..... G03G 15/0863; G03G 15/0865; G03G 15/1868; G03G 15/0886; G03G 21/1652; G03G 21/1878; G03G 2221/1684
USPC ..... 399/83, 111
See application file for complete search history.

(56) References Cited

U.S. PATENT DOCUMENTS 9,329,569 B2 5/2016 Tani

FOREIGN PATENT DOCUMENTS

| | | | |
|---|---|---|---|
| CN | 100100385340 | * | 4/2008 |
| JP | 2004294950 | A | 10/2004 |
| JP | 2008299124 | A | 12/2008 |
| JP | 2014102506 | A | 6/2014 |
| JP | 2018109732 | A | 7/2018 |

* cited by examiner

*Primary Examiner* — Hoan H Tran
(74) *Attorney, Agent, or Firm* — Rossi, Kimms & McDowell LLP

(57) ABSTRACT

Disclosed is a cartridge detachably attachable to a body of an image forming apparatus, the cartridge including: a memory member; and a support member supporting the memory member, wherein the memory member has a memory-side electric contact electrically connected to a body-side electric contact of the body when the cartridge is installed in the body, a first surface on which the memory-side electric contact is provided, and a second surface on an opposite side to the first surface, the support member has a memory mounting portion on which the memory member is mounted, the memory mounting portion has a first opposing portion that opposes the second surface of the memory member and is provided with a groove portion, and the memory member is mounted on the memory mounting portion, with the second surface being bonded to the first opposing portion by an adhesive.

10 Claims, 10 Drawing Sheets

VIEW SEEN FROM A

CARTRIDGE, IMAGE FORMING APPARATUS, AND METHOD FOR MANUFACTURING CARTRIDGE

BACKGROUND OF THE INVENTION

Field of the Invention

The present invention relates to a cartridge, an image forming apparatus, and a method for manufacturing the cartridge.

Description of the Related Art

Conventionally, image forming apparatuses that form images on sheet-shaped recording media such as paper by an electrophotographic system or the like have been known. Examples of the image forming apparatuses include copiers, facsimile machines, printers (such as laser beam printers and LED printers), and multifunction machines (multifunction printers) thereof.

Some of the image forming apparatuses employ a cartridge system. A cartridge is a unit detachably attachable to an image forming apparatus and is, for example, a process cartridge. The process cartridge includes a photosensitive member, process means (such as a charging member, a developing member, and a cleaning member) for acting on the photosensitive member, or the like. By the use of the cartridge, in the image forming apparatus a developer replenishing operation or the maintenance of various process means is facilitated. That is, the photosensitive member, the charging member, the developing member, the cleaning member, and the like are integrated beforehand as the cartridge inside a frame body, and the cartridge is made detachably attachable to an image forming apparatus body. With this, since a user himself/herself is allowed to perform the maintenance of the apparatus by replacing the cartridge, operability is improved.

Such a cartridge may have a memory such as an IC memory mounted thereon and make it possible to send and receive information between an apparatus body and the cartridge when the cartridge is installed in the apparatus body. Examples of information stored by the memory mounted on the cartridge include the lot number of the cartridge, the characteristics of an image forming apparatus, and the characteristics of process means. Thus, the maintenance of the apparatus body or the cartridge is facilitated. In addition, it is possible to perform image formation under optimal conditions by the control of the image formation according to information recorded in the memory.

Japanese Patent Application Laid-open No. 2014-102506 discloses a method for fixing a memory to the frame body or the component of a cartridge by an adhesive or the like in an image forming apparatus in which a memory as described above is installed.

SUMMARY OF THE INVENTION

A method for more reliably preventing a memory from dropping off a cartridge when the memory is provided in the cartridge of an image forming apparatus has been demanded.

The present invention has been made in view of the above problem and has an object of providing a technology for preventing a memory, which is provided in a cartridge installed in an image forming apparatus, from dropping off the cartridge.

The present invention employs the following configuration.

A cartridge detachably attachable to an image forming apparatus body includes:

a memory member that stores information relating to the cartridge; and a support member that supports the memory member, wherein the memory member has a memory-side electric contact that is electrically connected to a body-side electric contact of the image forming apparatus body when the cartridge is installed in the image forming apparatus body, a first surface on which the memory-side electric contact is provided, and a second surface on an opposite side to the first surface, the support member has a memory mounting portion on which the memory member is mounted, the memory mounting portion has a first opposing portion that opposes the second surface of the memory member and is provided with a groove portion, and the memory member is mounted on the memory mounting portion, with the second surface being bonded to the first opposing portion by an adhesive.

The present invention employs the following configuration.

A method for manufacturing a cartridge detachably attachable to an image forming apparatus body includes:

a step of preparing a memory member that stores information relating to the cartridge and a support member that supports the memory member; and a step of mounting the memory member on a memory mounting portion of the support member, wherein the memory member has a memory-side electric contact that is electrically connected to a body-side electric contact of the image forming apparatus body when the cartridge is installed in the image forming apparatus body, a first surface on which the memory-side electric contact is provided, and a second surface on an opposite side to the first surface, the support member is the memory mounting portion on which the memory member is mounted and has a first opposing portion that opposes the second surface of the memory member and that is provided with a groove portion, and the memory member is mounted on the memory mounting portion, with the second surface being bonded to the first opposing portion by an adhesive in the step of mounting.

According to the present invention, it is possible to provide a technology for preventing a memory, which is provided in a cartridge installed in an image forming apparatus, from dropping off the cartridge.

Further features of the present invention will become apparent from the following description of exemplary embodiments with reference to the attached drawings.

DESCRIPTION OF THE EMBODIMENTS

Hereinafter, modes for carrying out the present invention will be exemplarily described in detail with reference to the drawings and embodiments. However, the functions, materials, dimensions, shapes, and relative arrangements, or the like of constituting elements described in the embodiments will not intend to limit the scope of the present invention unless otherwise specifically noted.

Further, the functions, materials, dimensions, shapes, relative arrangements, or the like of members once described will be the same as those initially described unless otherwise specifically noted.

First Embodiment

Note that the following description illustrates a case in which four cartridges (also called process cartridges) are detachably attachable to an image forming apparatus. However, the number of the process cartridges installed in the image forming apparatus is not limited to four. The number of the process cartridges is appropriately set according to need. Further, the following description will illustrate a laser beam printer as a mode of the image forming apparatus. However, a target to which the present invention is applied is not limited to the laser beam printer as will be described later and may only include a configuration in which a memory is provided in any cartridge attached to and detached from the apparatus. That is, the cartridges are not limited to the process cartridges. The present invention is also grasped as the image forming apparatus having the cartridges.

Schematic Configuration of Image Forming Apparatus

Figure 2:
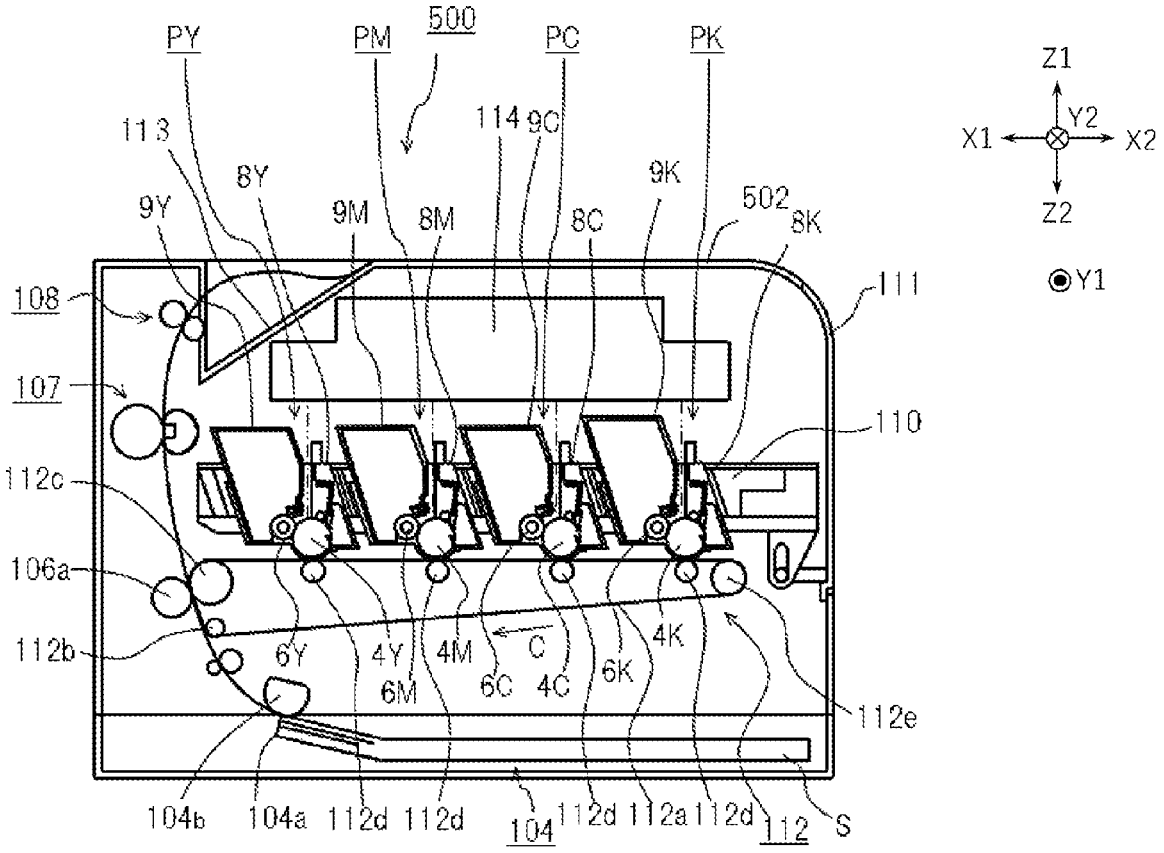
FIG. 2 is a cross-sectional view of an image forming apparatus.
Figure 3:
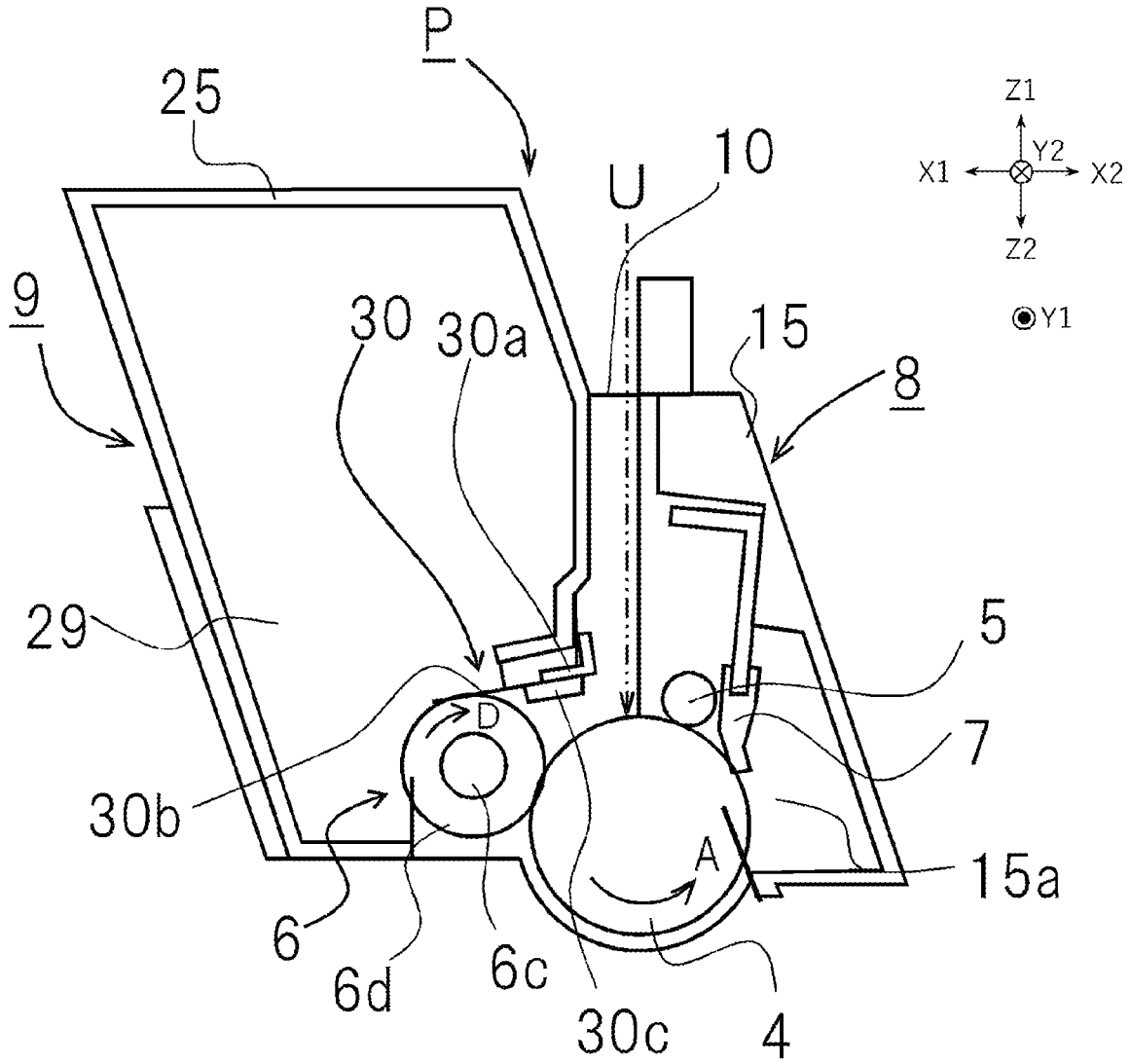
FIG. 3 is a cross-sectional view of a process cartridge.
Figure 4:
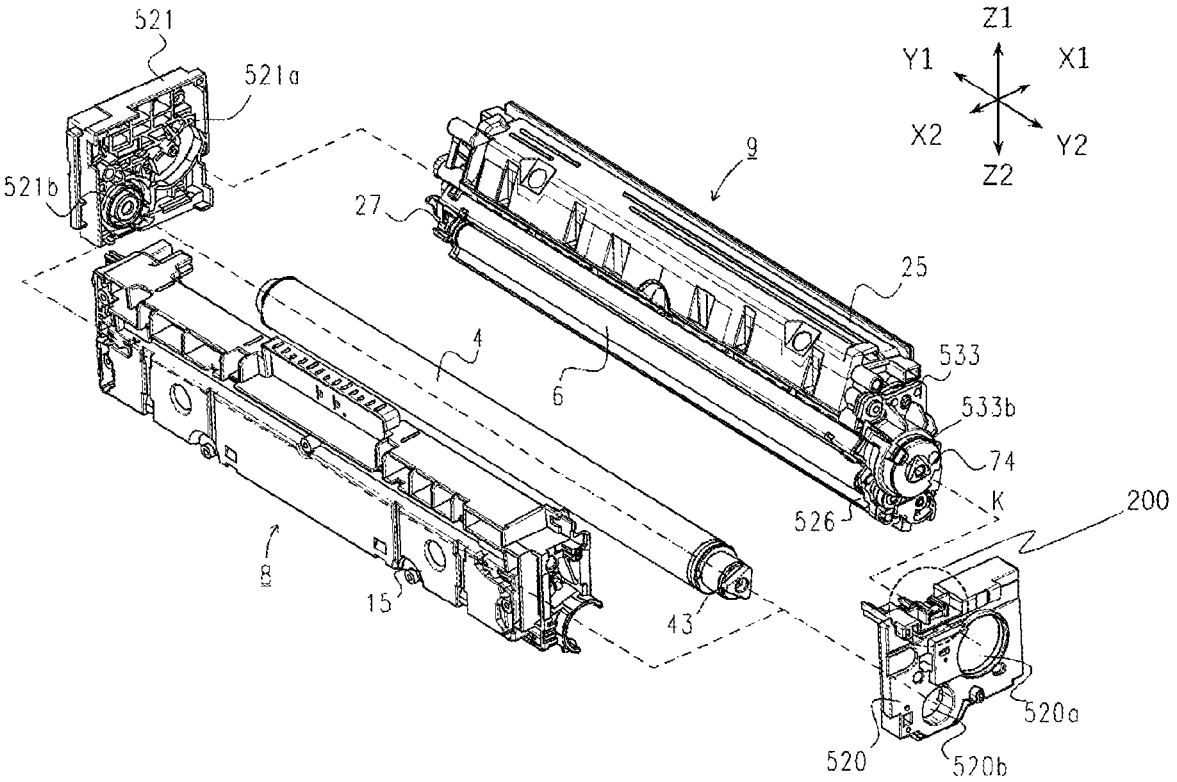
FIG. 4 is an assembling perspective view of the process cartridge.

FIG. 2 is a schematic cross-sectional view of an image forming apparatus 500. Further, FIG. 3 is a cross-sectional view of a process cartridge P. Further, FIG. 4 is an exploded perspective view of the process cartridge P when seen from a driving side that is one end side in the axial direction (hereinafter called the longitudinal direction) of a photosensitive member (hereinafter called a photosensitive drum 4).

The image forming apparatus 500 is a full-color (four-color) laser printer with an electrophotographic process that performs color image formation on a recording medium S. The image forming apparatus 500 employs a process cartridge system in which the process cartridges are detachably installed in an image forming apparatus body 502. The electrophotographic process includes processing to form an image based on image data on the recording medium S according to the control of a control unit 130. The control unit 130 is constituted by a control circuit such as a processor and a memory including an arithmetic computation resource and performs information processing according to a program or user's instructions. However, an information processing apparatus outside the image forming apparatus 500 may be used, or the processing may be shared with control circuits arranged in respective constituting elements inside the image forming apparatus.

Here, the side of the image forming apparatus 500 on which a front door 111 is provided will be defined as a front side (front surface), and the side of the image forming apparatus 500 that is opposite to the front side will be defined as a rear side (rear surface). Further, the right side of the image forming apparatus 500 when seen from the front side will be defined as a driving side, and the left side thereof will be defined as a non-driving side. Further, the upper side of the image forming apparatus 500 when seen from the front side will be defined as an upper surface, and the lower side thereof will be defined as a lower surface. FIG. 2 is a cross-sectional view of the image forming apparatus 500 when seen from the non-driving side of the image forming apparatus 500, wherein the near side of a space corresponds to the non-driving side of the image forming apparatus 500, the right side of the space corresponds to the front side thereof, and the back side of the space corresponds to the driving side thereof.

Further, the front-and-rear direction of the image forming apparatus 500 when seen from the front side will be defined as an X direction, a direction from the front side to the rear side will be defined as X1, and a direction from the rear side to the front side will be defined as X2. Further, the right-and-left direction of the image forming apparatus 500 when seen from the front side will be defined as a Y direction, a direction from the non-driving side to the driving side (a direction from the near side to the back side of the space in FIG. 2) will be defined as Y1, and a direction from the driving side to the non-driving side (a direction from the back side to the near side of the space in FIG. 2) will be defined as Y2. Further, a vertical direction will be defined as a Z direction, a direction from a lower part to an upper part will be defined as Z1, and a direction from the upper part to the lower part will be defined as Z2.

The image forming apparatus 500 of FIG. 2 is brought into a state in which the process cartridges P are installed in the image forming apparatus body 502. The process cartridges P include a first process cartridge PY, a second process cartridge PM, a third process cartridge PC, and a fourth process cartridge PK. Note that the first to fourth process cartridges (PY, PM, PC, and PK) will be collectively called the process cartridges P when there is no need to distinguish the first to fourth process cartridges from each other. The first to fourth process cartridges (PY, PM, PC, and PK) are arranged substantially horizontally.

A rotational driving force is transmitted to the process cartridges P from the driving output unit (not shown) of the image forming apparatus body 502. In addition, a bias voltage (such as a charging bias and a developing bias) is applied to the process cartridges P from the power-supply output unit (not shown) of the image forming apparatus body 502. The process cartridges P perform a prescribed operation when the driving output unit transmits power or when the power-supply output unit supplies a voltage according to an instruction signal from the control unit 130.

Each of the first to fourth process cartridges P (PY, PM, PC, and PK) has a similar electrophotographic process mechanism and uses a different color of a developer (also called toner). The first process cartridge PY accommodates yellow (Y) toner inside a developer container 25 (see FIG. 3) and forms a yellow toner image on the surface of a photosensitive drum 4. The second process cartridge PM accommodates magenta (M) toner inside a developer container 25 and forms a magenta toner image on the surface of a photosensitive drum 4. The third process cartridge PC accommodates cyan (C) toner inside a developer container 25 and forms a cyan toner image on the surface of a photosensitive drum 4. The fourth process cartridge PK accommodates black (K) toner inside a developer container 25 and forms a black toner image on the surface of a photosensitive drum 4.

As shown in FIG. 2, a laser scanner unit 114 serving as exposure means is provided over the first to fourth process cartridges P (PY, PM, PC, and PK). The laser scanner unit 114 outputs laser light U according to image information. Then, the laser light U passes through exposure windows 10 of the process cartridges P to perform scanning exposure on the surfaces of the photosensitive drums 4.

Under the first to fourth process cartridges P (PY, PM, PC, and PK), an intermediate transfer belt unit 112 serving as a transfer member is provided. The intermediate transfer belt unit 112 has a driver roller 112*e*, a turn roller 112*c*, and a tension roller 112*b*, and a transfer belt 112*a* having flexibility is laid over these rollers.

The lower surfaces of the photosensitive drums 4 of the first to fourth process cartridges P (PY, PM, PC, and PK) are in contact with the upper surface of the transfer belt 112*a*. Portions at which the transfer belt 112*a* and the photosensitive drum 4 contact each other are primary transfer portions. Inside the transfer belt 112*a*, primary transfer rollers 112*d* are provided so as to oppose the photosensitive drums 4.

A secondary transfer roller 106*a* is caused to contact the turn roller 112*c* via the transfer belt 112*a*. A portion at which the transfer belt 112*a* and the secondary transfer roller 106*a* contact each other is a secondary transfer portion. A feeding unit 104 is provided under the intermediate transfer belt unit 112. The feeding unit 104 has a paper feeding tray 104*a* that loads and accommodates the recording medium S and a paper feeding roller 104*b*.

At an upper left part inside the image forming apparatus body 502 in FIG. 2, a fixing apparatus 107 and a paper discharging apparatus 108 are provided. The upper surface of the image forming apparatus body 502 serves as a paper catching tray 113. Toner images are fixed onto the recording medium S by fixing means provided in the fixing apparatus 107, and then the recording medium S is discharged to the paper catching tray 113.

As shown in FIG. 3, the process cartridges P have a drum unit 8 and a developing unit 9 and rotatably support the photosensitive drum 4. The drum unit 8 includes charging means and cleaning means as process means for acting on the photosensitive drum 4. The developing unit 9 includes developing means for developing an electrostatic latent image on the photosensitive drum 4 and a developer container 25 that accommodates toner. The drum unit 8 and the developing unit 9 are connected to each other.

Image Forming Operation

An operation for forming a full-color image will be described. First, the photosensitive drums 4 of the first to fourth process cartridges P (PY, PM, PC, and PK) are rotated and driven at a prescribed speed (in an arrow A direction in FIG. 3).

The transfer belt 112*a* is also rotated and driven in the forward direction (an arrow C direction in FIG. 2) of the rotation of the photosensitive drums at a speed corresponding to the speed of the photosensitive drums 4.

The laser scanner unit 114 is also driven. In synchronization with the driving of the laser scanner unit 114, the charging rollers 5 uniformly charge the surfaces of the photosensitive drums 4 so as to have a prescribed polarity and potential in the respective process cartridges. The laser scanner unit 114 performs scanning exposure on the surfaces of the respective photosensitive drums 4 with laser light U according to the image signals of the respective colors.

Thus, electrostatic latent images corresponding to the image signals of the corresponding colors are formed on the surfaces of the respective photosensitive drums 4. The formed electrostatic latent images are developed by developing rollers 6 that are rotated and driven (in an arrow D direction in FIG. 3) at a prescribed speed.

By such an electrophotographic image forming process operation, a yellow toner image corresponding to the yellow component of a full-color image is formed on the photosensitive drum 4 of the first process cartridge PY. Then, the toner image is primarily transferred onto the transfer belt 112*a*.

Similarly, a magenta toner image corresponding to the magenta component of the full-color image is formed on the photosensitive drum 4 of the second process cartridge PM. Then, the toner image is superposed on the yellow toner image that has been transferred onto the transfer belt 112*a* to be primarily transferred.

Similarly, a cyan toner image corresponding to the cyan component of the full-color image is formed on the photosensitive drum 4 of the third process cartridge PC. Then, the toner image is superposed on the yellow and magenta toner images that have been transferred onto the transfer belt 112*a* to be primarily transferred.

Similarly, a black toner image corresponding to the black component of the full-color image is formed on the photosensitive drum 4 of the fourth process cartridge PK. Then, the toner image is superposed on the yellow, magenta, and cyan toner images that have been transferred onto the transfer belt 112*a* to be primarily transferred.

Thus, the full-color (four-color) unfixed toner images of the yellow, magenta, cyan, and black colors are formed on the transfer belt 112*a*.

Meanwhile, the recording medium S is separated one by one and fed at a prescribed control timing. The recording medium S is introduced into the secondary transfer portion that is the portion at which the secondary transfer roller 106*a* and the transfer belt 112*a* contact each other at a prescribed control timing.

Then, in a process in which the recording medium S is transported to the secondary transfer portion, the four-color superposed toner images on the transfer belt 112*a* are collectively transferred onto the surface of the recording medium S.

Entire Configuration of Process Cartridges

As described above, the process cartridges P include the photosensitive drum 4 and the process means for acting on the photosensitive drum 4. The process means includes the charging roller 5 serving as charging means for charging the photosensitive drum 4, the developing roller 6 serving as a developing member that attaches toner to the photosensitive drum 4 and develops a formed latent image, and a cleaning blade 7 serving as cleaning means for removing residual toner on the surface of the photosensitive drum 4. Further, the process cartridges P have the drum unit 8 and the developing unit 9.

Configuration of Drum Unit

As shown in FIGS. 3 and 4, the drum unit 8 is constituted by the photosensitive drum 4, the charging roller 5, the cleaning blade 7, a drum frame body 15, a waste toner accommodation portion 15*a*, a driving-side cartridge cover member 520, and a non-driving-side cartridge cover member 521.

The photosensitive drum 4 is rotatably supported by the driving-side cartridge cover member 520 and the non-driving-side cartridge cover member 521 that are provided at both ends in the longitudinal direction of the process cartridge P. At the driving-side cartridge cover member 520, a memory mounting portion 200 that will be described later is formed as indicated by a dashed circle.

Further, as shown in FIG. 4, a photosensitive-member coupling member 43 to which a driving force for rotating the photosensitive drum 4 is input is provided on one end side in the longitudinal direction of the photosensitive drum 4. The photosensitive-member coupling member 43 engages a coupling (not shown) serving as the drum driving output unit of the image forming apparatus body 502, and the driving force of the driving motor (not shown) of the image forming apparatus body 502 is transmitted to the photosensitive drum 4. The charging roller 5 is supported by the drum frame body 15 so as to be capable of being driven and rotated in contact with the photosensitive drum 4. Further, the cleaning blade 7 is supported by the drum frame body 15 so as to contact the peripheral surface of the photosensitive drum 4 with a prescribed pressure. Untransferred toner removed from the peripheral surface of the photosensitive drum 4 by the cleaning blade 7 is accommodated in the waste toner accommodation portion 15*a* inside the drum frame body 15.

Configuration of Developing Unit

As shown in FIG. 3, the developing unit 9 is constituted by the developing roller 6, a developing blade 30, and the developer container 25. The developer container 25 has a toner accommodation portion 29 that accommodates toner to be supplied to the developing roller 6 and the developing blade 30 that controls the layer thickness of toner on the peripheral surface of the developing roller 6. The developing blade 30 is obtained by mounting an elastic member 30*b* that is sheet-shaped metal having a thickness of about 0.1 mm on a support member 30*a* that is a metal material having an L-shaped cross section by welding or the like. The developing blade 30 is mounted on the developer container 25 by fixing screws 30*c*. Positions at which the developing blade 30 is fixed by the fixing screws 30*c* are, for example, two places at one end and the other end in the longitudinal direction.

The developing roller 6 is constituted by a cored bar 6*c* made of a metal material and a rubber portion 6*d*. As shown in FIG. 4, the developing roller 6 is rotatably supported by the driving-side bearing 526 and the non-driving-side bearing 27 that are mounted at both ends in the longitudinal direction of the developer container 25. Further, a developing coupling member 74 to which a driving force for rotating the developing roller 6 is input is provided on one end side in the longitudinal direction of the developing unit 9. The developing coupling member 74 engages a coupling (not shown) serving as the developing driving output unit of the image forming apparatus body 502, and the driving force of the driving motor (not shown) of the image forming apparatus body 502 is transmitted to the developing unit 9. The driving force that has been input to the developing unit 9 is transmitted by a driving row (not shown) provided inside the developing unit 9 to rotate the developing roller 6 in an arrow D direction in FIG. 3. On one end side in the longitudinal direction of the developing unit 9, a developing cover member 533 that supports and covers the developing coupling member 74 or the driving row (not shown) is provided.

Assembling of Drum Unit and Developing Unit

The assembling of the drum unit 8 and the developing unit 9 will be described with reference to FIG. 4. The drum unit 8 and the developing unit 9 are combined with each other by the driving-side cartridge cover member 520 and the non-driving-side cartridge cover member 521 that are provided at both ends in the longitudinal direction of the process cartridge P. Note that the driving-side cartridge cover member 520 serves as a support member for a memory member in the present embodiment. However, a memory mounting position is not limited to the driving-side cartridge cover member 520. A memory may be mounted on any support member that constitutes the process cartridge P such as the drum unit 8, the developing unit 9, the driving-side cartridge cover member 520, and the non-driving-side cartridge cover member 521.

The driving-side cartridge cover member 520 provided on one end side in the longitudinal direction of the process cartridge P is provided with a support hole 520*a* for swingably (movably) supporting the developing unit 9. Further, the non-driving-side cartridge cover member 521 provided on the other end side in the longitudinal direction of the process cartridge P is provided with a cylindrical support portion 521*a* for swingably supporting the developing unit 9. In addition, the driving-side cartridge cover member 520 and the non-driving-side cartridge cover member 521 are provided with support hole portions 520*b* and 521*b* for rotatably supporting the photosensitive drum 4, respectively. Here, the outer diameter portion of a cylindrical portion 533*b* of the developing cover member 533 is fitted into the support hole 520*a* of the driving-side cartridge cover member 520 on one end side. Further, the support portion 521*a* of the non-driving-side cartridge cover member 521 is fitted into the hole of the non-driving-side bearing 27 on the other end.

In addition, both ends in the longitudinal direction of the photosensitive drum 4 are fitted into the support hole portion 520*b* of the driving-side cartridge cover member 520 and the support hole portion 521*b* of the non-driving-side cartridge cover member 521, respectively. Then, the driving-side cartridge cover member 520 and the non-driving-side cartridge cover member 521 are fixed to the drum frame body 15 by screws (not shown), bonding, or the like. That is, the driving-side cartridge cover member 520 and the non-driving-side cartridge cover member 521 are integrated with the drum frame body 15 to constitute the drum unit 8. Thus, the developing unit 9 is movably (rotatably) supported by the driving-side cartridge cover member 520 and the non-driving-side cartridge cover member 521 with respect to the drum unit 8 (the photosensitive drum 4).

Here, an axis line that connects the support hole 520*a* of the driving-side cartridge cover member 520 and the support portion 521*a* of the non-driving-side cartridge cover member 521 to each other and that is the rotation center of the developing unit 9 will be called a swinging axis K. The cylindrical portion 533*b* of the developing cover member 533 is coaxial with the developing coupling member 74, and the developing unit 9 is configured to receive a driving force from the image forming apparatus body 502 via the developing coupling member 74 in the swinging axis K.

Process Cartridge Attachment/Detachment Configuration

A cartridge tray 110 (that will be called a tray below) that supports the process cartridges P will be described in detail with reference to FIGS. 2, 5, and 6. The cross-sectional view of FIG. 5 is a cross-sectional view of the image forming apparatus 500 showing a state in which the front door 111 is opened and the tray 110 is positioned inside the image forming apparatus body 502.

Figure 6:
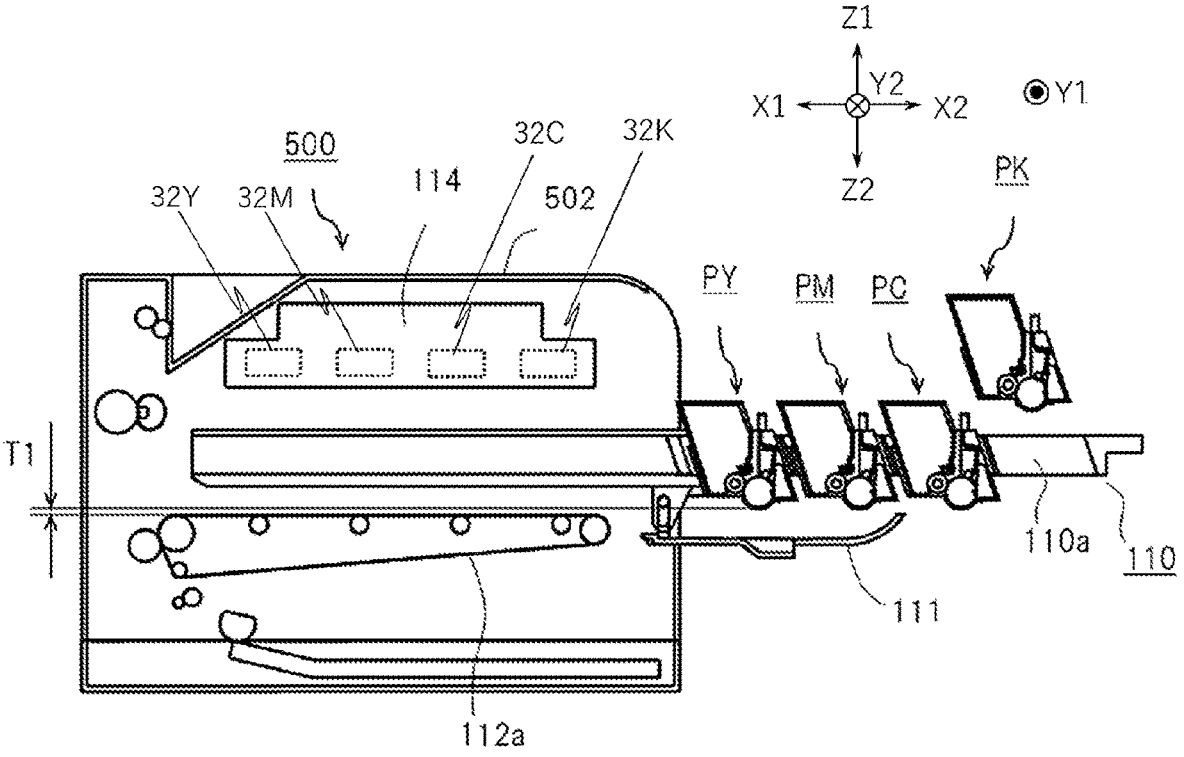
FIG. 6 is a cross-sectional view of the image forming apparatus.

Further, the cross-sectional view of FIG. 6 is a cross-sectional view of the image forming apparatus 500 showing a state in which the front door 111 is opened and the tray 110 is positioned outside the image forming apparatus body 502.

Figure 5:
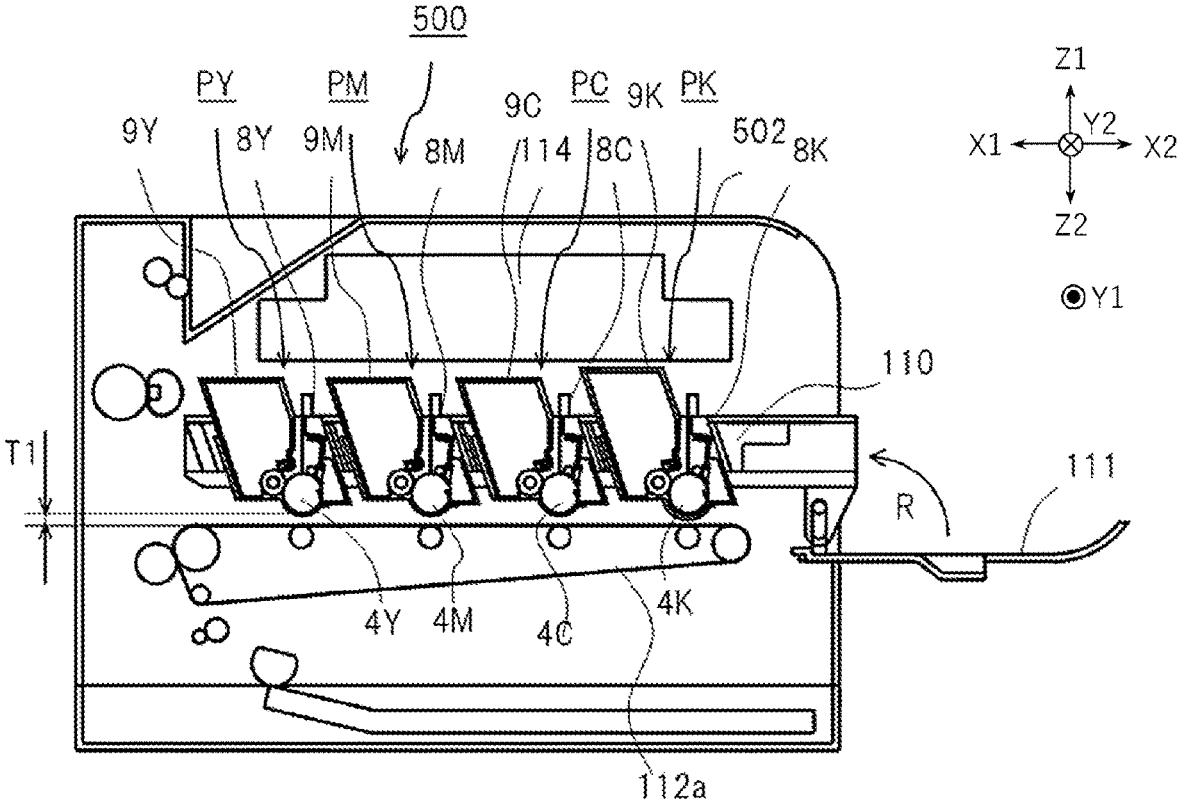
FIG. 5 is a cross-sectional view of the image forming apparatus.

As shown in FIGS. 5 and 6, the tray 110 is movable to the arrow X1 direction (pressing direction) and the arrow X2 direction (withdrawing direction) with respect to the image forming apparatus body 502. That is, the tray 110 is provided to be withdrawable from and pushable to the image forming apparatus body 502 and configured to be movable in a substantially horizontal direction in a state in which the image forming apparatus body 502 is installed on a horizontal plane. As described above, the tray 110 is movable between a position at which the tray 110 is accommodated in the image forming apparatus body 502 and a position at which the tray 110 is withdrawn from the image forming apparatus body 502.

Here, a state (the state of FIG. 6) in which the tray 110 is positioned outside the image forming apparatus body 502 will be called an outside position. Further, a state (the state of FIG. 5) in which the tray 110 is positioned inside the image forming apparatus body 502 with the front door opened and the photosensitive drums 4 and the transfer belt 112*a* are separated from each other by a gap T1 will be called a first inside position.

The tray 110 has installation portions 110*a* in which the process cartridges P are installable. In the tray 110, the installation portions 110*a* are provided corresponding to the first to fourth process cartridges (PY, PM, PC, and PK), respectively. A user is allowed to attach/detach the process cartridges P to/from the installation portions 110*a* when the tray 110 is arranged at the outside position. When the respective process cartridges P are installed in the installation portions 110*a*, the driving-side cartridge cover members 520 and the non-driving-side cartridge cover members 521 are supported in contact with the tray 110.

The respective process cartridges P arranged in the installation portions 110*a* move to the inside of the image forming apparatus body 502 as the tray 110 moves from the outside position to the first inside position. As shown in FIG. 5, the gap T1 between the transfer belt 112*a* and the photosensitive drums 4 is maintained during the movement of the process cartridges P. Accordingly, the tray 110 on which the process cartridges P are mounted is movable to the inside of the image forming apparatus body 502 without contacting the transfer belt 112*a* by the photosensitive drums 4.

Here, a direction that is perpendicular to the arrow X direction (X1 and X2) of FIG. 5 and that is perpendicular to the axis lines of the photosensitive drums 4 will be called a Z direction (arrows Z1 and Z2 of FIG. 5). The tray 110 is movable from the first inside position to a second inside position (the state of FIG. 2) in the arrow Z2 direction of FIG. 5. When the tray 110 is arranged at the second inside position, the photosensitive drums 4 and the transfer belt 112*a* are in contact with each other and an image forming process is executable. In the image forming apparatus 500, the tray 110 moves in the Z2 direction as the user closes the front door 111 in the arrow R direction from the state in which the front door 111 is opened as shown in FIG. 5, whereby the tray 110 is arranged at the second inside position.

As described above, the tray 110 makes it possible to collectively install the plurality of process cartridges P at a position at which image formation is allowed inside the image forming apparatus body 502.

Positioning of Tag Connector and Memory Tag

Figure 7:
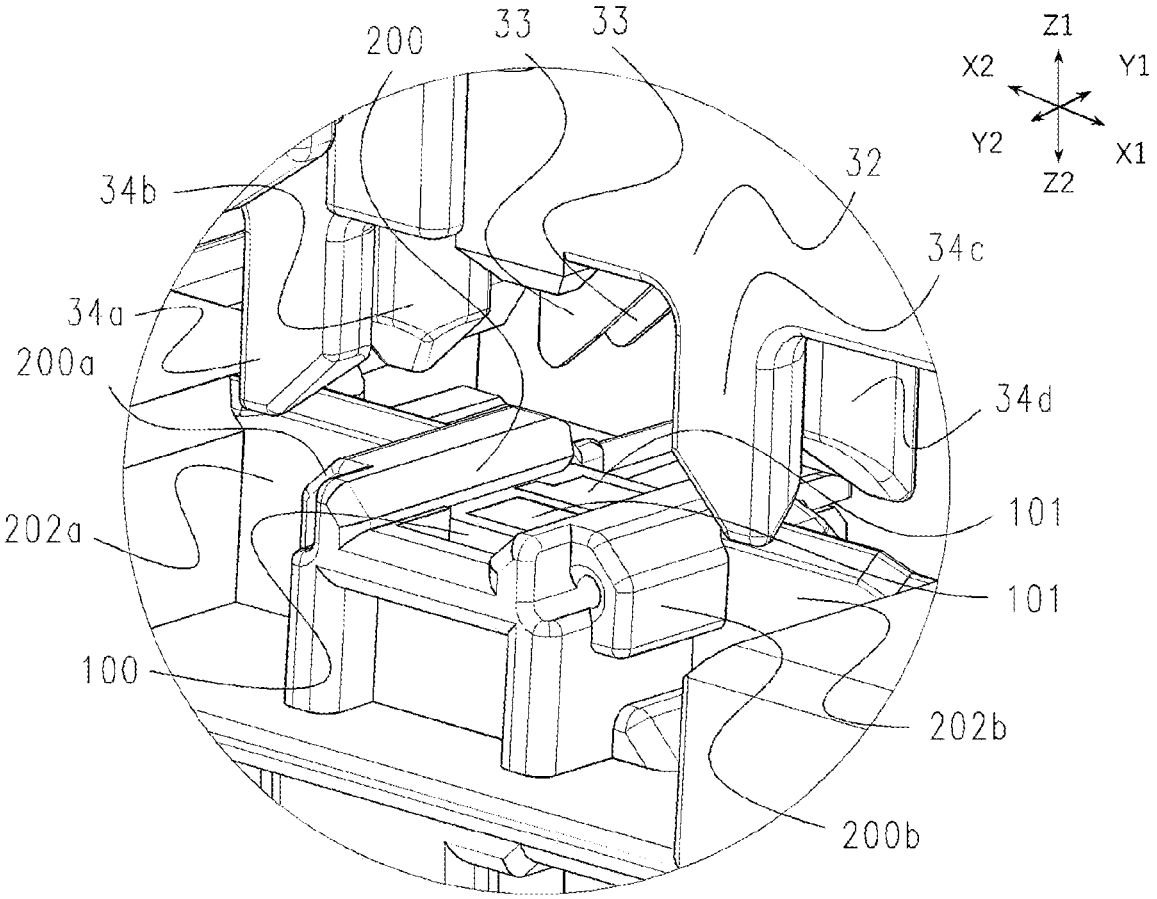
FIG. 7 is an explanatory view of the contacts of a memory member.

FIG. 7 is a perspective view showing a configuration for positioning a memory tag 100 (memory member) provided in the process cartridge P and a tag connector 32 provided in the image forming apparatus body 502. The tag connector 32 is provided with body electrode portions 33 (body-side electric contacts) capable of contacting contact portions 101 (memory-side electric contacts) provided in the memory tag 100 and contact positioning portions 34 (34*a*, 34*b*, 34*c*, and 34*d*) formed on both sides with the body electrode portions 33 held therebetween. Since the body electrode portions 33 are connected to a control circuit such as the control unit 130 by electric wiring (not shown), it is possible to send and receive information between the memory and the body.

Meanwhile, the memory mounting portion 200 for mounting the memory tag 100 is formed at the driving-side cartridge cover member 520. On one side of the memory mounting portion 200, a positioning rib 202*a* is provided so as to be held between the contact positioning portions 34*a* and 34*b*, and a lateral wall portion 200*a* is provided so as to oppose the contact positioning portions 34*a* and 34*b*. Further, on a side opposite to the side of the memory mounting portion 200 on which the lateral wall portion 200*a* is provided, a positioning rib 202*b* is provided so as to be held between the contact positioning portions 34*c* and 34*d*, and a lateral wall portion 200*b* is provided so as to oppose the contact positioning portions 34*c* and 34*d*.

When the tray 110 on which the process cartridges P are mounted is inserted into the image forming apparatus body 502, the lateral wall portions 200*a* and the positioning ribs 202*a* are positioned with respect to the contact positioning portions 34*a* and 34*b* and the lateral wall portions 200*b* and positioning ribs 202*b* are positioned with respect to the contact positioning portions 34*c* and 34*d*. Thus, the tag connectors 32 of the image forming apparatus body 502 are positioned with respect to the memory mounting portions 200 of the process cartridges P. By the positioning, the body electrode portions 33 of the tag connectors 32 and the contact portions 101 of the memory tags 100 contact each other to be electrically connected to each other. When the front door 111 is closed after the movement of the tray 110 to the second inside position at this time, the tag connectors 32 descend from positions indicated by dashed lines in FIG. 6 and engage the memory mounting portions 200.

Configurations of Memory Tag and Memory Mounting Portion

Figure 1A:
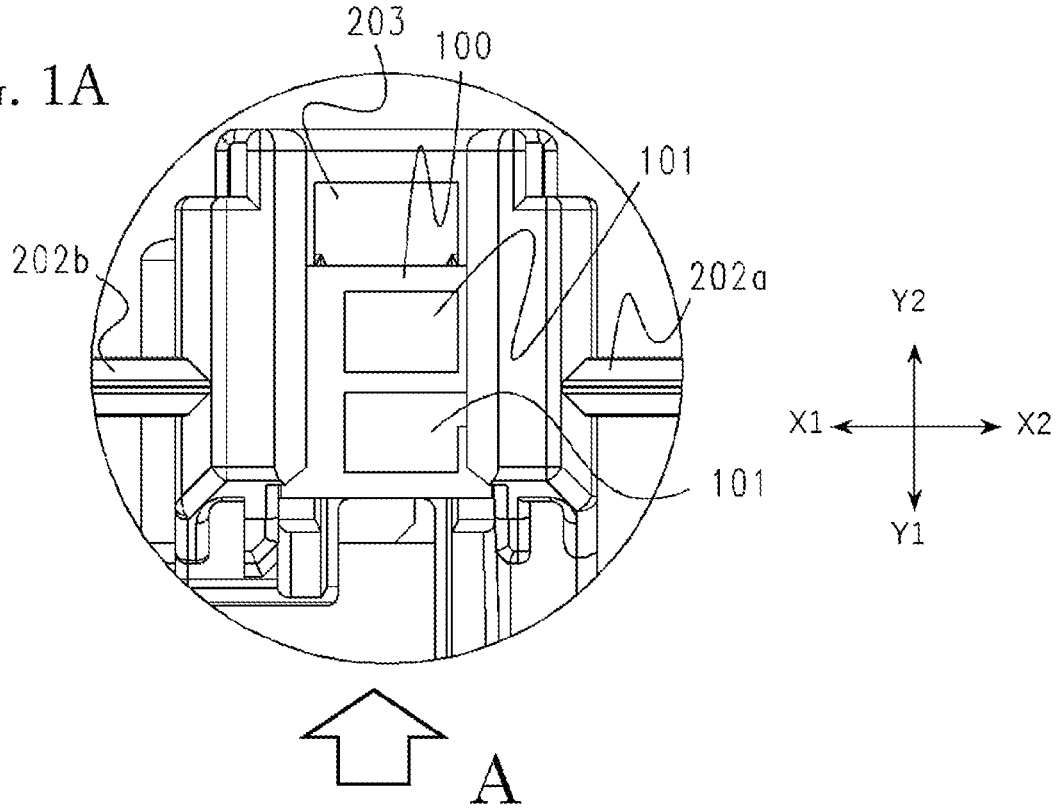
FIGS. 1A and 1B are explanatory views of a memory mounting portion on which a memory member is mounted.
Figure 1B:
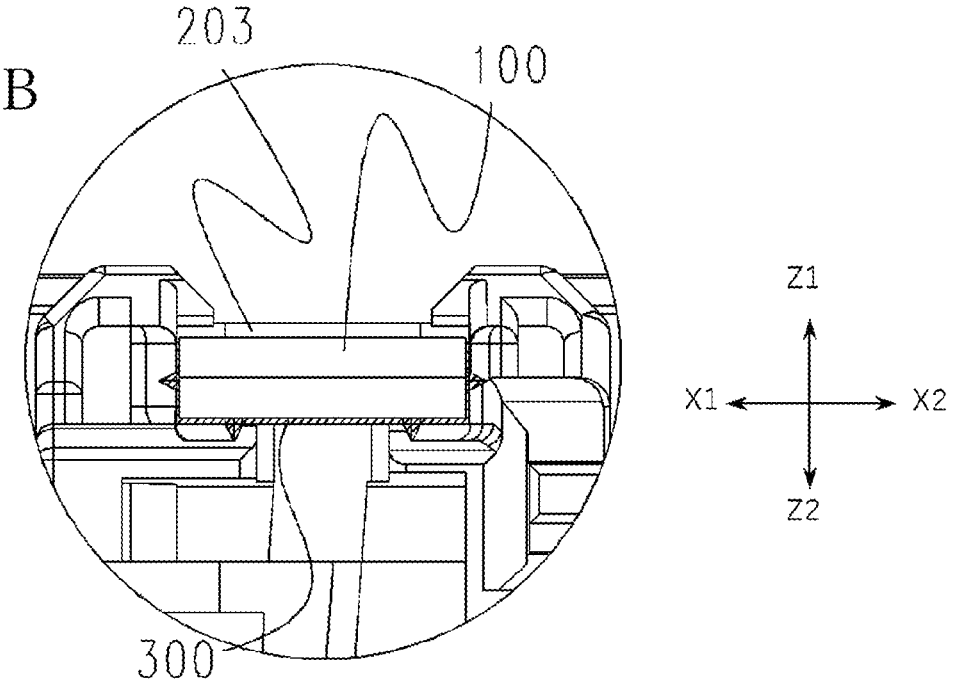
Figure 8:
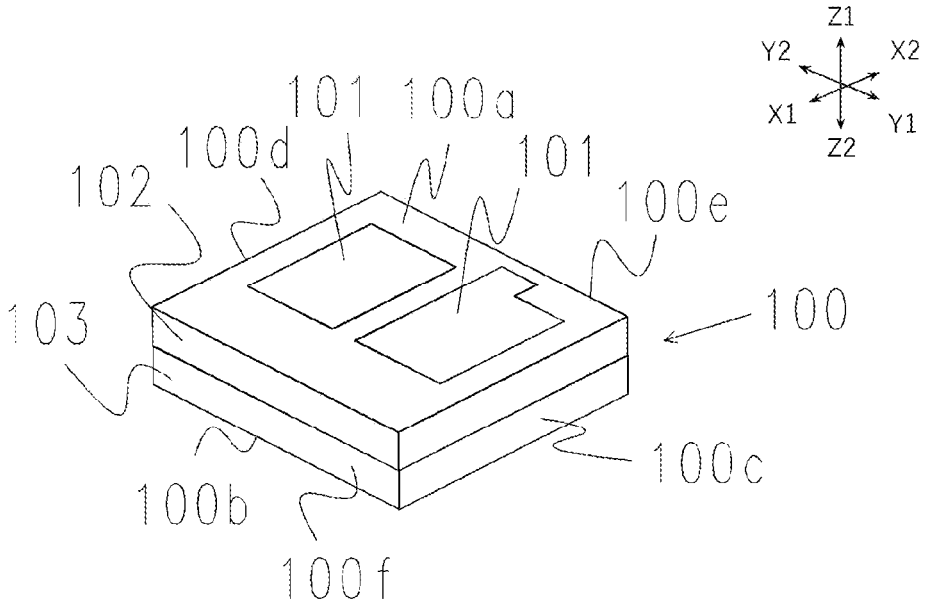
FIG. 8 is a perspective view of the memory member.
Figure 9A:
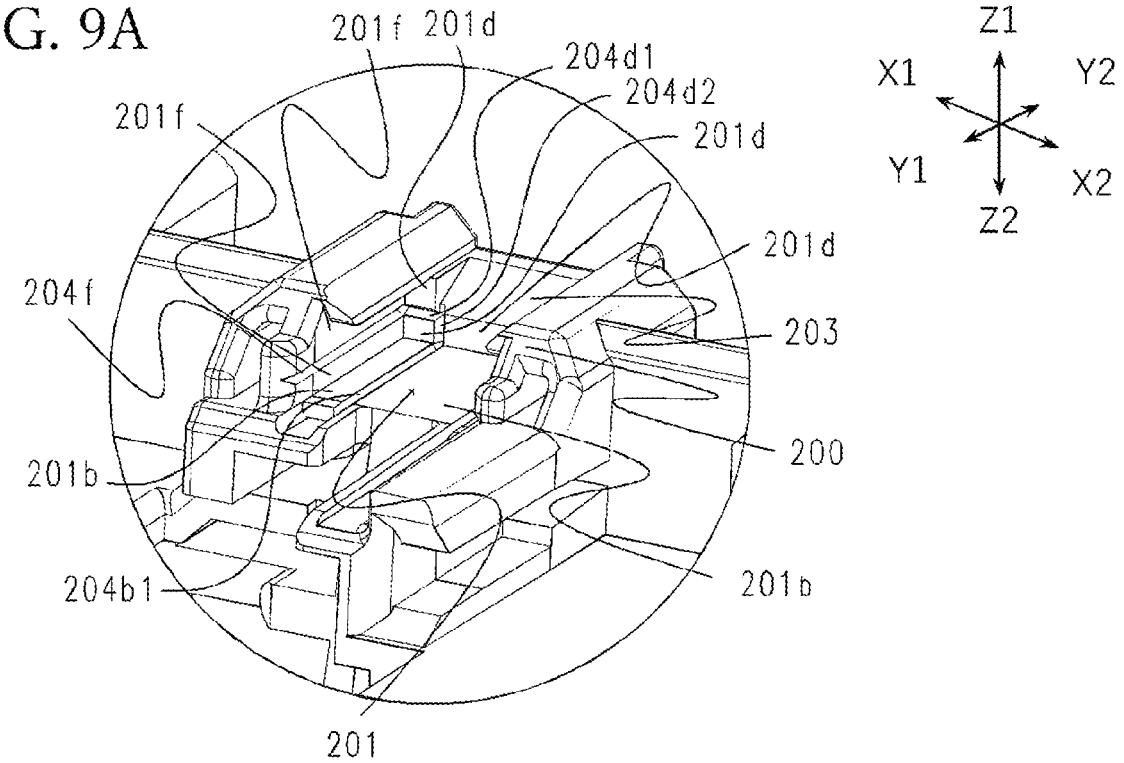
FIGS. 9A and 9B are perspective views of the memory mounting portion.
Figure 9B:
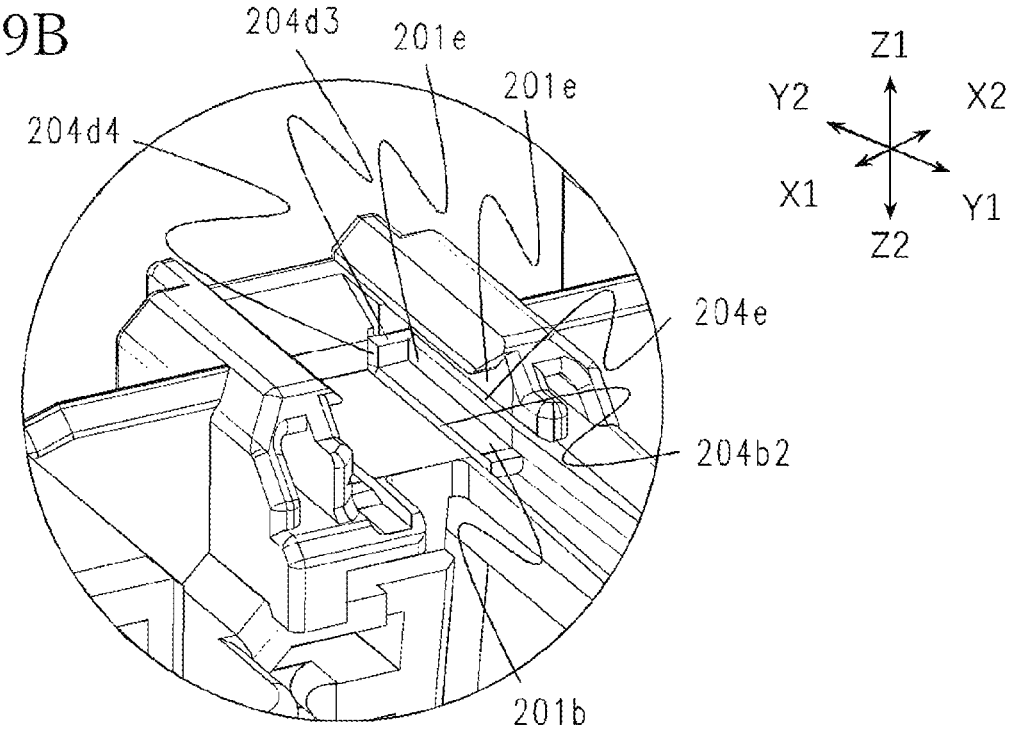

Next, the configurations of the memory tag 100 and the memory mounting portion 200 will be described in detail. FIG. 8 is a perspective view of the memory tag 100. FIGS. 9A and 9B are perspective views of the memory mounting portion 200 before the assembling of the memory tag 100. FIGS. 1A and 1B are a plan view and a side view of the memory mounting portion 200 in a state in which the memory tag 100 is fixed by an adhesive 300, respectively.

In the memory tag 100, the lot number of a cartridge, the characteristic information of the cartridge, the characteristic information of the image forming apparatus 500 to which the memory tag 100 is attached, or the like is stored. Using information stored in the memory tag, it is possible to facilitate the maintenance of the image forming apparatus body 502 or the process cartridge P. The type of a memory member is not limited so long as the memory member is capable of storing such information, and a general storage element such as an IC memory may be used.

Memory Tag

As shown in FIG. 8, the memory tag 100 is a plate-shaped member having an area of 5.5 mm×5 mm and a thickness of 1.4 mm. In FIG. 8, the Y direction and the X direction are a long side and a short side, respectively. The memory tag 100 includes a contact surface 100*a* (first surface) on which the contact portions 101 are arranged, a bottom surface 100*b* (second surface) on a side opposite to the contact surface 100*a*, and a plurality of lateral surfaces orthogonal to the contact surface 100*a* and the bottom surface 100*b*. The lateral surfaces include a front surface 100*c* not retained by the memory mounting portion 200 when the memory tag 100 is attached to the driving-side cartridge cover member 520, a rear surface 100*d* opposing the front surface 100*c*, a lateral surface 100*e* arranged between the front surface 100*c* and the rear surface 100*d*, and a lateral surface 100*f* opposing the lateral surface 100*e*.

The memory tag 100 is constituted by the two layers of a memory substrate 102 on which a storage element (not shown) is mounted and a protection portion 103 that is integrated with the memory substrate 102 and covers and protects the storage element. In the example shown in the figure, the memory substrate 102 and the protection portion 103 have the same degree of thickness. On the upper surface of the memory substrate 102, the contact portions 101 electrically connected to the storage element are formed in an exposed state. The protection portions 103 may be made of, for example, resin or the like.

Memory Mounting Portion

Next, a configuration for mounting the memory tag 100 on the process cartridge P will be described with reference to FIGS. 1A and 1B and FIGS. 8 to 10C. Generally, the memory tag 100 is mounted on the process cartridge P by being accommodated in the memory mounting portion 200 and fixed by the adhesive 300.

Specifically, as shown in FIG. 4, the memory mounting portion 200 is provided at the driving-side cartridge cover member 520 serving as the exterior portion of the process cartridge P. The memory mounting portion 200 is capable of accommodating the memory tag 100. When the memory tag 100 is fixed by the adhesive 300 in a state in which the memory mounting portion 200 accommodates the memory tag 100, the memory tag 100 capable of storing various information is mounted on the process cartridge P.

As shown in FIGS. 1A and 1B and FIGS. 9A and 9B, the memory mounting portion 200 is formed at the prescribed position of the driving-side cartridge cover member 520 as a substantially square depressed portion opened in a direction (Z1) opposite to a direction (Z2) in which the process cartridge P is installed in the image forming apparatus body 502. The depressed portion functions as an accommodation portion that accommodates the memory tag 100. At the bottom of the depressed portion serving as an accommodation portion, a bottom surface opposing portion 201*b* (first opposing portion) and V-grooves 204*b*1 and 204*b*2 (groove portions) that oppose the bottom surface 100*b* of the memory tag 100 are provided.

Further, one of the lateral walls of the accommodation portion is provided with a rear surface opposing portion 201*d*, a notch portion 203, and V-grooves 204*d*1, 204*d*2, 204*d*3, and 204*d*4 so as to oppose the rear surface 100*d* of the memory tag 100. Here, the notch portion 203 is provided in a region on the side of the contact surfaces 100*a* from a midway point in the thickness direction (Z direction) of the memory tag 100 in the rear surface opposing portion 201*d*. The notch portion 203 is arranged at a position more distant from the rear surface 100*d* than the rear surface opposing portion 201*d*.

Further, another one of the lateral walls of the accommodation portion is provided with a lateral surface opposing portion 201*e* and a V-groove 204*e* so as to oppose the lateral surface 100*e* of the memory tag 100. Further, still another one of the lateral walls of the accommodation portion is provided with a lateral surface opposing portion 201*f* and a V-groove 204*f* so as to oppose the lateral surface 100*f* of the memory tag 100.

Here, the second opposing portion of the present invention corresponds to any of the rear surface opposing portion 201*d*, the lateral surface opposing portion 201*e*, and the lateral surface opposing portion 201*f*.

When the second opposing portion corresponds to the rear surface opposing portion 201*d*, the lateral surface of the present invention corresponds to the rear surface 100*d*. The first lateral surface region of the lateral surface that is close to the first surface opposes a first opposing region that is arranged on the upper side of the rear surface opposing portion 201*d*. The second lateral surface region of the lateral surface that is close to the second surface opposes a second opposing region that is arranged on the lower side of the rear surface opposing portion 201*d*. Further, the gap between the first lateral surface region and the first opposing region corresponds to the notch portion 203. The adhesive 300 flowing from the notch portion 203 (gap) flows through the groove portion and spreads over the contact surface between the memory tag and the accommodation portion.

The adhesive 300 is present between the bottom surface 100*b* and the bottom surface opposing portion 201*b*, between the rear surface 100*d* and the rear surface opposing portion 201*d*, between the lateral surface 100*e* and the lateral surface opposing portion 201*e*, between the lateral surface 100*f* and the lateral surface opposing portion 201*f*, and at the V-grooves 204 (204*b*1, 204*b*2, 204*d*1, 204*d*2, 204*d*3, 204*d*4, 204*e*, and 204*f*). Accordingly, the memory tag 100 is fixed to the memory mounting portion 200 via the adhesive 300. As an example of the adhesive 300, a cyanoacrylate adhesive that is an adhesive having adequate bonding strength against the respective materials of the memory tag 100 and the memory mounting portion 200 is available. However, the type of the adhesive is not limited to this, and an appropriate one may only be used according to the arrangement easiness such as flowability of the adhesive in a bonding region, the application easiness of the adhesive, the fixation strength of the adhesive during fixation, and compatibility with members.

Mounting and Fixation of Memory Tag on Memory Mounting Portion

Next, a method for mounting and fixing the memory tag 100 on the memory mounting portion 200 will be described with reference to FIGS. 10A to 10C. In the present embodiment, the adhesive 300 is applied after the memory tag 100 is inserted and installed into the memory mounting portion 200.

Figure 10A:
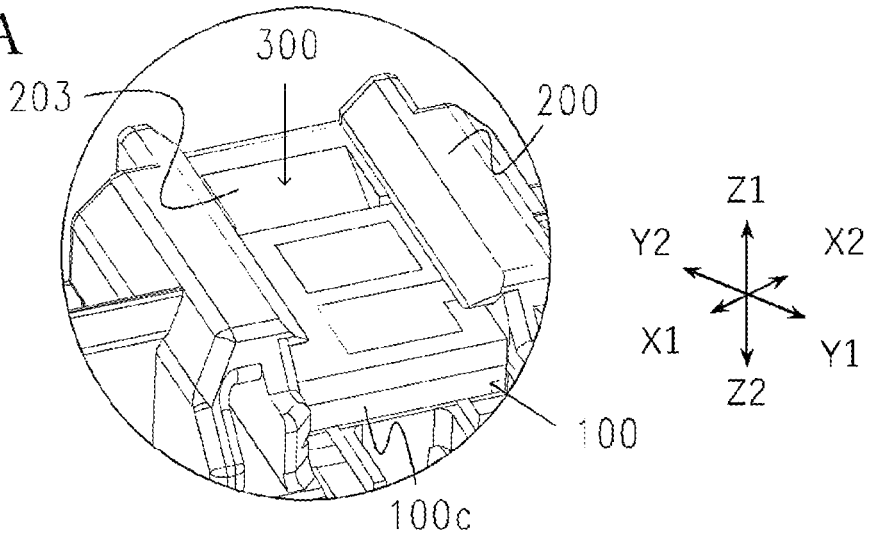
FIGS. 10A to 10C are explanatory views of the mounting of the memory member on the memory mounting portion.

First, as shown in FIG. 10A, the memory tag 100 is inserted into the accommodation portion of the memory mounting portion 200. For example, the plate-shaped memory tag 100 is caused to horizontally move along a guide groove. The memory mounting portion 200 may be configured to be capable of holding the memory tag 100 at this time. Then, the adhesive 300 is put from the notch portion 203 to be arranged in a bonding region.

Figure 10B:
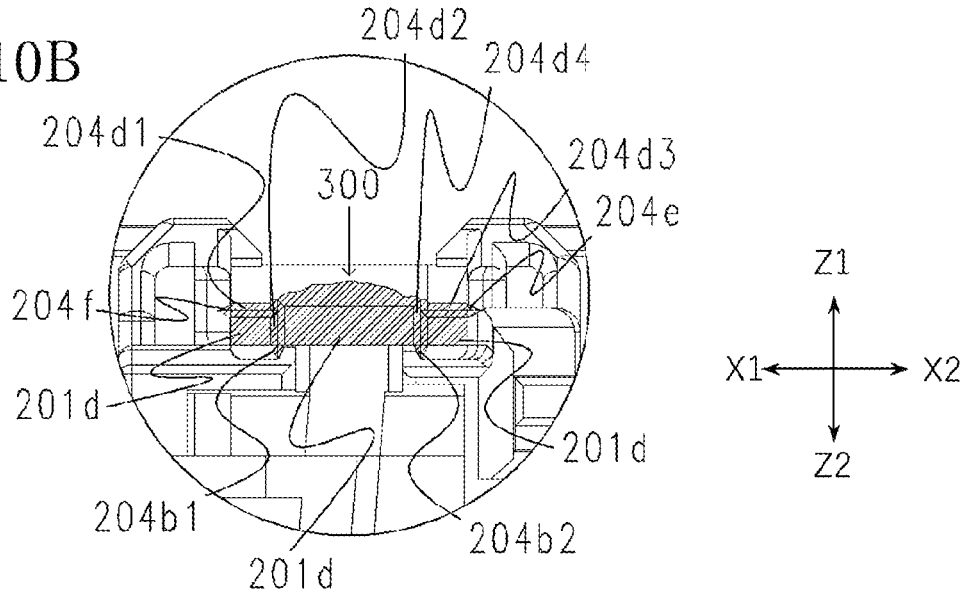

FIG. 10B is a view when seen from the same direction as that of FIG. 1B, showing a state in which the adhesive 300 is spreading. FIG. 10B omits the description of the memory tag 100. As shown in FIG. 10B, the adhesive 300 put from the notch portion 203 spreads over the rear surface opposing portion 201*d* and the V-grooves 204 (204*b*1, 204*b*2, 204*d*1, 204*d*2, 204*d*3, 204*d*4, 204*e*, and 204*f*) and then moves in the direction of the front surface 100*c* along the V-grooves 204 (204*b*1, 204*b*2, 204*d*1, 204*d*2, 204*d*3, 204*d*4, 204*e*, and 204*f*).

Figure 10C:
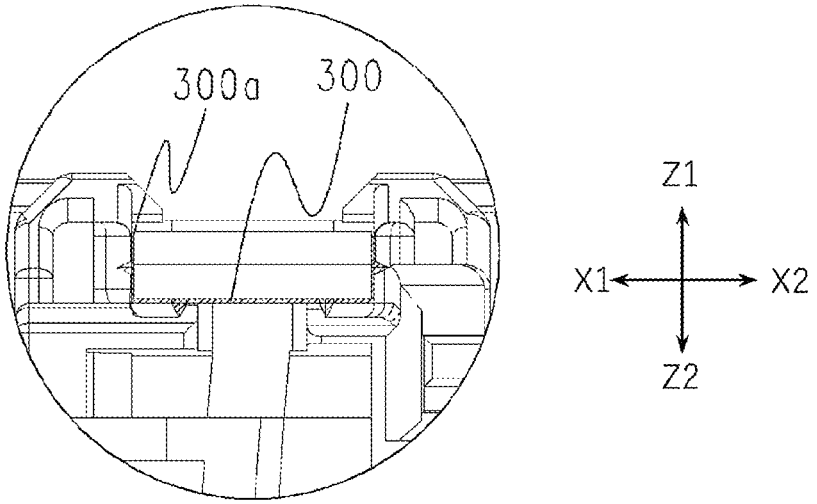

FIG. 10C is a view when seen from the same direction as that of FIG. 10B in which the memory tag 100 is described without being omitted. As shown in FIG. 10C, the adhesive 300 flowing into the V-grooves 204 oozes and spreads between the bottom surface 100*b* and the bottom surface opposing portion 201*b*, between the lateral surface 100*e* and the lateral surface opposing portion 201*e*, and between the lateral surface 100*f* and the lateral surface opposing portion 201*f*.

As described above, the plurality of surfaces of the memory tag 100 are bonded by the adhesive 300 spreading via the V-grooves 204. Therefore, compared with a case in which only the bottom surface 100*b* is bonded, it is possible to more firmly fix the memory tag 100 to the memory mounting portion 200.

Here, the adhesive 300 is arranged by such an amount that an upper surface 300*a* of the adhesive 300 becomes lower than the contact surface 100*a*. Thus, the adhesive 300 is prevented from being attached to the contact surface 100*a*. Accordingly, it is possible to stably secure the electric connection between the tag connector 32 and the memory tag 100.

As described above, it is possible to firmly fix the mounting portion since the adhesive 300 spreads between the memory tag 100 and the memory mounting portion 200 when applied via the V-grooves. As a result, it is possible to prevent the memory tag 100 from dropping off the memory mounting portion 200.

Note that the memory mounting portion 200 is provided at the driving-side cartridge cover member 520 of the process cartridge P in the above description. However, the present invention is not limited to this, and the memory mounting portion 200 may only be arranged appropriately according to the entire configuration of the apparatus, the structures of the process cartridges P and the image forming apparatus body 502, and the positional relationships between the process cartridges P and the image forming apparatus body 502.

Further, the numbers of the V-grooves and the arrangement places of the V-grooves are not limited to the examples shown in the figures but may only be designed appropriately according to the materials or sizes of the memory tag 100 and the memory mounting portion 200, the type or characteristics of the adhesive 300, or the like. In terms of the design, consideration may be given to the flowing easiness of the adhesive, the bonding easiness of the adhesive, desired fixation strength, or the like. Further, the V-grooves are not limited to linear ones but may have curves or bends. Further, the V-grooves may cross or connect to each other.

The V-grooves are provided on the bottom surface and the lateral surfaces of the accommodation portion in the above description but are not limited to such positions. For example, even if the V-grooves are provided only on the bottom surface or the lateral surfaces, it is possible to obtain favorable application performance or fixation performance compared with conventional simple bonding with an adhesive.

Further, the cross-sectional shape of the grooves is not limited to a V-shape when the grooves are provided. For example, grooves having a cross-sectional shape such as a semicircle shape, a U-shape, and a rectangle shape (including a rectangle having curves at corners) may be provided.

In addition, the above memory mounting configuration is applicable also to cartridges other than the process cartridges. Examples of such cartridges include a drum cartridge having a photosensitive drum, a developing cartridge including a developer bearing member for supplying a developer to an image bearing member on which a toner image is formed and a developer accommodation unit accommodating the developer, a developer cartridge accommodating a developer, and an inkjet cartridge accommodating ink to be used in an inkjet recording apparatus. Besides, the above memory attachment configuration is applicable to a cartridge which is configured to be detachably attachable to the apparatus body of an image forming apparatus and on which a memory member is mounted. Accordingly, as an image forming apparatus to which the above configuration is applied, an inkjet recording system other than an electrophotographic image forming system and an electrostatic recording image forming system is, for example, available.

The present invention is also grasped as a method for manufacturing a cartridge or a method for manufacturing an image forming apparatus. In this case, the present invention includes a step of preparing a support member and a memory member and a step of mounting the memory member on the support member. In the mounting step, a method in which an adhesive is put in a bonding region via grooves as described above is used to perform fixation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-115896, filed Jul. 3, 2020, which is hereby incorporated by reference wherein in its entirety.

What is claimed is:

1. A cartridge detachably attachable to an image forming apparatus body, the cartridge comprising:

a memory member that stores information relating to the cartridge; and a support member that supports the memory member, wherein the memory member has a memory-side electric contact that is electrically connected to a body-side electric contact of the image forming apparatus body when the cartridge is installed in the image forming apparatus body, a first surface on which the memory-side electric contact is provided, and a second surface on an opposite side to the first surface, the support member has a memory mounting portion on which the memory member is mounted, the memory mounting portion has a first opposing portion that opposes the second surface of the memory member and is provided with a groove portion, and the memory member is mounted on the memory mounting portion, with the second surface being bonded to the first opposing portion by an adhesive.

2. The cartridge according to claim 1, wherein the memory member is in a state in which the second surface is bonded to the first opposing portion of the memory mounting portion by the adhesive spreading over the first opposing portion from the groove portion.

3. The cartridge according to claim 1, wherein the memory mounting portion further has a second opposing portion that opposes one of a plurality of lateral surfaces of the memory member and that is provided with a groove portion, and the memory member is mounted on the memory mounting portion, with also the lateral surface being bonded to the second opposing portion by the adhesive.

4. The cartridge according to claim 3, wherein the lateral surface includes a first lateral surface region that is close to the first surface and a second lateral surface region that is close to the second surface, and the second opposing portion includes a second opposing region that contacts the second lateral surface region of the lateral surface and a first opposing region that does not contact the first lateral surface region of the lateral surface and creates a gap with the first lateral surface region, when the memory member is mounted on the memory mounting portion.

5. The cartridge according to claim 1, wherein the groove portion has a cross-sectional shape that is any of a V-shape, a U-shape, a semicircle shape, and a rectangle shape.

6. An image forming apparatus comprising:

an image forming apparatus body; and a cartridge that is detachably attachable to the image forming apparatus body, wherein the cartridge is the cartridge according to claim 1, and the image forming apparatus body has a body-side electric contact that is electrically connected to the memory-side electric contact.

7. The image forming apparatus according to claim 6, further comprising:

a tray that is capable of installing the cartridge and movable between a position at which the tray is withdrawn from the image forming apparatus body and a position at which the tray is accommodated in the image forming apparatus body, wherein the memory-side electric contact of the memory member of the cartridge, after being installed in the tray, is electrically connected to the body-side electric contact of the image forming apparatus body when the tray is accommodated in the image forming apparatus body.

8. A method for manufacturing a cartridge detachably attachable to an image forming apparatus body, the method comprising:

a step of preparing a memory member that stores information relating to the cartridge and a support member that supports the memory member; and a step of mounting the memory member on a memory mounting portion of the support member, wherein the memory member has a memory-side electric contact that is electrically connected to a body-side electric contact of the image forming apparatus body when the cartridge is installed in the image forming apparatus body, a first surface on which the memory-side electric contact is provided, and a second surface on an opposite side to the first surface, the support member is the memory mounting portion on which the memory member is mounted and has a first opposing portion that opposes the second surface of the memory member and that is provided with a groove portion, and the memory member is mounted on the memory mounting portion, with the second surface being bonded to the first opposing portion by an adhesive in the step of mounting.

9. The method for manufacturing a cartridge according to claim 8, wherein the memory mounting portion further has a second opposing portion that opposes one of a plurality of lateral surfaces of the memory member and that is provided with a groove portion, and the memory member is mounted on the memory mounting portion, with also the lateral surface being bonded to the second opposing portion by the adhesive in the step of mounting.

10. The method for manufacturing the cartridge according to claim 9, wherein the lateral surface includes a first lateral surface region that is close to the first surface and a second lateral surface region that is close to the second surface, the second opposing portion includes a second opposing region that contacts the second lateral surface region of the lateral surface and a first opposing region that does not contact the first lateral surface region of the lateral surface and creates a gap with the first lateral surface region, when the memory member is mounted on the memory mounting portion, the groove portion of the second opposing portion is provided in the second opposing region, and the adhesive flows into the groove portion of the second opposing portion from the gap between the first lateral surface region and the first opposing region in the step of mounting.

* * * * *